United States Patent [19]

Sorrentino

[11] 4,268,087

[45] May 19, 1981

[54] SWINGING CHAISE LOUNGE

[75] Inventor: Vincent P. Sorrentino, Parkland, Fla.

[73] Assignee: Bright Industries Inc., Ft. Lauderdale, Fla.

[21] Appl. No.: 73,785

[22] Filed: Sep. 10, 1979

[51] Int. Cl.[3] ..... A63G 9/00

[52] U.S. Cl. ..... 297/273; 5/130; 272/85

[58] Field of Search ..... 297/273, 274, 275, 276, 297/277, 278, 279, 280, 281, 282; 272/85; 5/127, 130; 285/DIG. 16

[56] References Cited

U.S. PATENT DOCUMENTS

| | | | |
|---|---|---|---|
| 445,492 | 1/1891 | Billeaux | 297/278 |
| 1,925,425 | 9/1933 | Wilent | 5/62 X |
| 2,443,786 | 6/1948 | Cooper | 297/277 |
| 2,701,604 | 2/1955 | St. Louis | 272/85 |
| 2,747,653 | 5/1956 | Obradovich | 297/184 X |
| 4,171,832 | 10/1979 | Metcalfe | 285/DIG. 16 |

FOREIGN PATENT DOCUMENTS

| | | | |
|---|---|---|---|
| 1188309 | 3/1959 | France | 297/273 |
| 266057 | 9/1929 | Italy | 297/273 |

*Primary Examiner*—James T. McCall
*Attorney, Agent, or Firm*—Alfred E. Wilson

[57] ABSTRACT

A swinging chaise lounge having a chaise portion pivotally mounted on a stand whose frame consists of tubular members cemented together the chaise portion pivoted to an oblique angle with the vertical when in a non-use position with the lower end of the chaise portion engaging the stand whereby the intended user of the swinging chaise lounge may readily and easily place himself on the chaise lounge without endangering himself.

2 Claims, 3 Drawing Figures

SWINGING CHAISE LOUNGE

BACKGROUND OF THE INVENTION

1. Field of the Invention

This invention relates to chaise lounges and is more particularly directed to a swinging chaise lounge.

2. Description of the Prior Art

A problem arises in the use of swinging chaise lounges when a person attempts to place or remove himself from the chaise lounge. To be sure that the swinging chaise lounge does not move when a person is attempting to mount or to get off the chaise lounge, he usually asks another person to hold onto the chaise lounge. If the chaise lounge that is free to swing moves while a person is climbing on or off the chaise lounge, he is apt to lose his balance, fall off the chaise lounge and thereby inure himself. The present invention contemplates avoiding the possibility of a person injuring himself due to movement of a swinging chaise lounge while getting on or off same.

SUMMARY OF THE INVENTION

Therefore, a principal object of the present invention is to provide a swinging chaise lounge with means for preventing the swinging movement of the lounge when a person is getting on and off the lounge, and thereby avoiding the possibility of the person injuring himself.

A further object of the present invention is to provide a swinging chaise lounge that is positioned at an angle to the vertical in its non-use position for permitting a person to place his body on or remove his body from the chaise lounge readily, conveniently and without danger of the chaise lounge moving which may cause the person to fall and injure himself.

A still further object of the present invention is to provide a chaise lounge that is mounted on a stand for swinging movement whereby the chaise lounge may be locked with relation to the stand to prevent the movement of the chaise lounge while a person is mounting or removing himself from the chaise lounge.

With these and other objects in view, the invention will be best understood from a consideration of the following detailed description taken in connection with the accompanying drawing forming a part of this disclosure, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
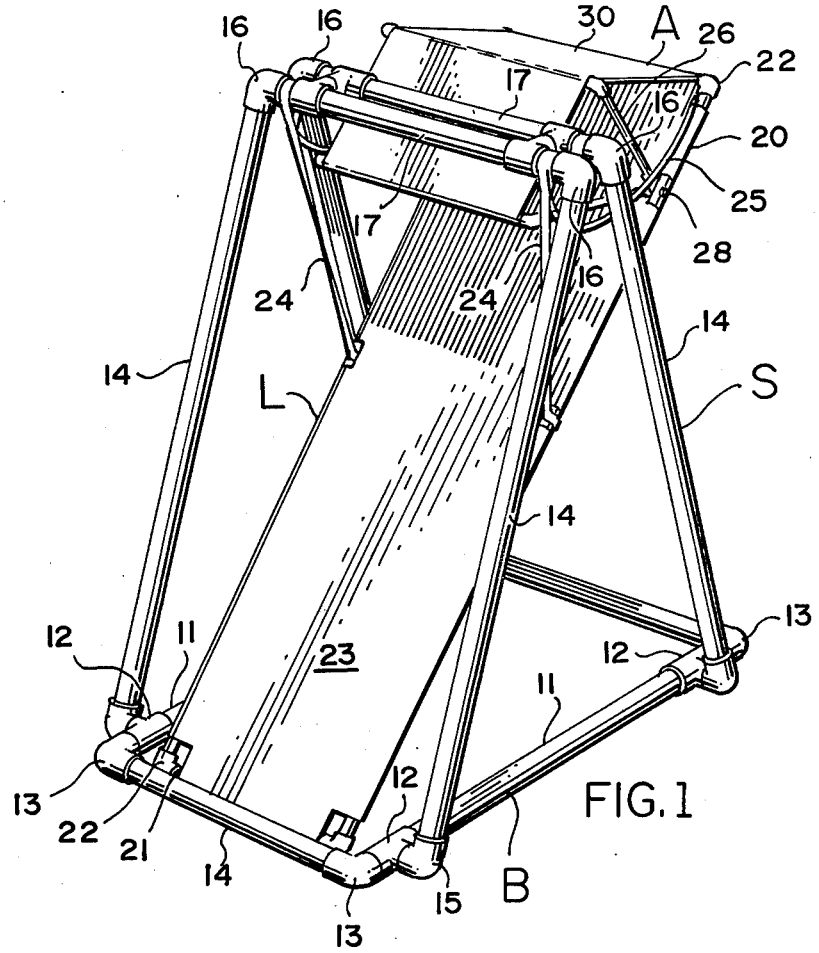
FIG. 1 is a perspective view of a swinging chaise lounge constructed in accordance with my invention.

Referring to the drawing wherein like numerals are used to designate similar parts throughout the several views, there is shown a swinging chaise lounge consisting of a lounge -L- mounted for swinging movement on a stand -S- and having a base frame -B- all of which are constructed of tubing made preferably of plastic, cemented together by couplings as is explained in detail hereinafter.

The base frame -B- constructed into a rectangular shape consists of a pair of elongated tubular members 11 having T-shaped tubular members 12 telescopically cemented to the ends thereof with the opposite end of the T-shaped members 12 being cemented to one end of an elbow tubular member 13. The other end of each of the elbow tubular members 13 are cemented to the end of tubular members 14 thereby forming the rectangular base -B-.

The elongated upwardly extending tubular members **14*a* have their lower ends cemented to one end of tubular elbows 15 whose other end is cemented to the T-shaped tubular member 12. The upper ends of each of the elongated tubular members 14*a* are cemented to one end of an elbow shaped tubular member 16 whose other end of each pair of opposing elbows 16 are joined by a tubular member 17. The upper ends of the stand -S- are held rigidly together by means of T-shaped tubular members 18 telescopically mounted in proximity of the end portions of the tubular members 17. The opposing T-shaped tubular members 18 are joined together by a relatively short tubular member 19** cemented thereto.

Figure 2:
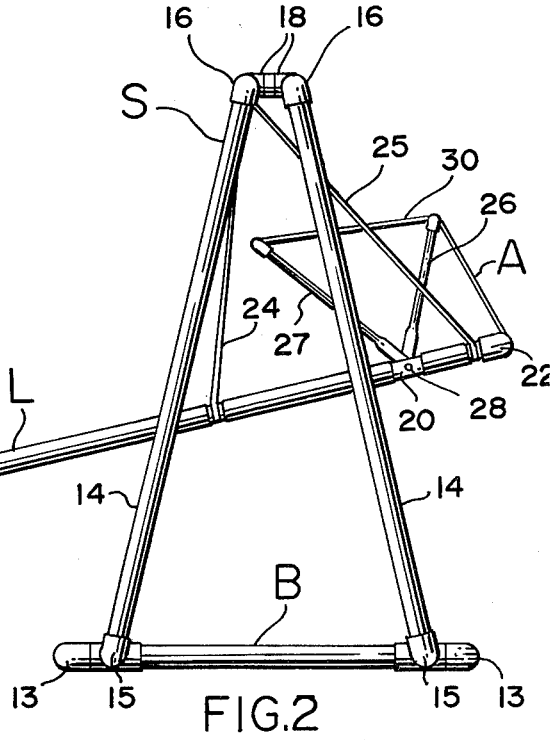
FIG. 2 is a side elevational view of the chaise lounge when in use.

The lounge -L- consists of a framework that is rectangular in shape formed by two pairs of tubular members 20 and 21 cemented to elbows 22 at their ends. Stretched across the framework of the lounge -L- is a sheet of canvas 23 having its looped edge portions secured about the tubing 20,21 to form a firm support for a person's body. The lounge -L- is supported for swinging movement on the stand -S- by two pairs of shrouds 24 and 25 extending diagonally from the tubular members 17 to the lounge support tubular members 20. The shrouds 25 are secured to the rear end of the tubular members 20 while the shrouds 24 are secured to tubular members 20 at a position beyond the center thereof, thereby making the lounge -L- unbalanced and heavy at the foot end as best shown by FIG. 2. Also, the length of the lounge -L- is such that when in a non-use position as shown by FIG. 3, the foot portion of the lounge -L- is wedged beneath the tubular member **14*a* with the lounge -L- being supported by the shrouds 24**.

Mounted on the head portion of the lounge -L- is a collapsible shade producing awning -A- consisting of a pair of U-shaped brackets 26 and 27 pivoted as at 28 to the tubular members 20 and supporting a sheet of canvas 30 that extends from the tubular member 21 to the cross member of the bracket 27. When not in use the brackets 26 and 27 are pivoted rearwardly on their pivots 28 to lie on the lounge -L- in a collapsed condition.

Figure 3:
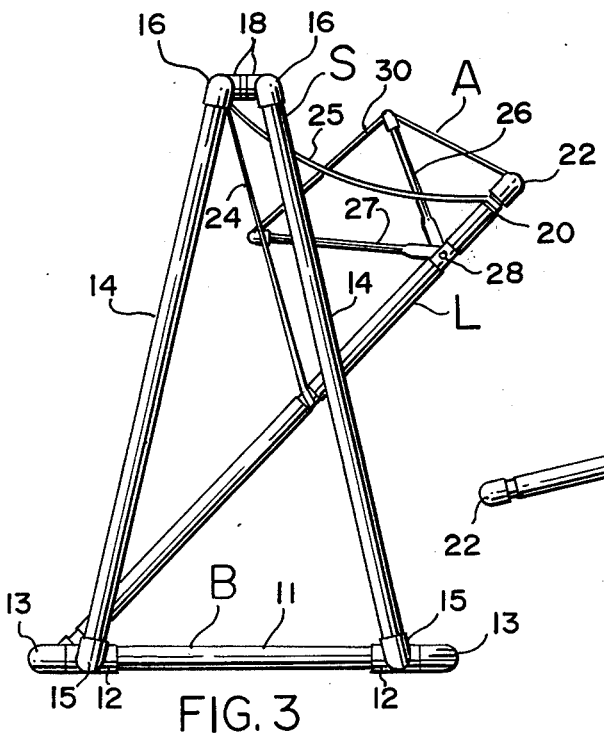
FIG. 3 is a similar view of the chaise lounge when not in use and in position to receive a person who wishes to use the lounge.

With the lounge -L- in the non-use position as shown by FIG. 3, the lounge is in the ready position to receive a person who desires to make use of the lounge without any danger to his person. The person merely steps on the tubular member 14, turns his back to the lounge -L-, bends his knees and lowers himself backwards until he is lying on the lounge -L-. Then he straightens his knees as he pushes against the tubular member **14*a* to lift the foot portion of the lounge -L- from beneath the tubular member 14 and thereby free the lounge -L- to swing to the position shown by FIG. 2. The lounge -L- is now supported by the shrouds 24 and 25 and the person can not swing or lie quietly thereon. When he wishes to get off the lounge -L- he pushes on the tubular members 14***a* to swing the lounge -L- backwards as he leans forwardly to shift his weight toward the foot portion of the lounge -L-. The lounge will swing downwardly at the foot portion until it engages the tubular member 14 and becomes wedged thereunder. The person can then remove himself easily from the lounge -L- by merely stepping forwardly, leaving the lounge -L- in the position shown by FIG. 3 in readiness to receive another person desiring to use the lounge.

What I claim as new is:

1. A swinging chaise lounge having a rectangular base consisting of (a) parallel spaced apart elongated tubular side members, and (b) transversely extending parallel spaced apart elongated tubular end members cooperating with the side members to define the rectangular base, (c) T shaped tubular connector members telescopically cemented to the ends of the spaced apart side members and having laterally extending stub support portions, (d) elbow tubular connector members telescopically cemented to the outer ends of the T shaped connector members at one end and at their other ends cemented to the end members of the rectangular base, (e) spaced apart upwardly extending tubular angularly converging side support members, (f) elbow connecting members cemented to the bottom ends of the side support members and the laterally extending stub support portions of the T shaped tubular connector members, (g) transversely extending tubular connecting means between the upper ends of the angularly converging side support members on opposite sides of the rectangular base, (h) a lounge including an elongated rectangular shaped framework and a sheet of flexible material having looped end portions secured about the members defining the rectangular shaped lounge framework to provide a support for a person's body, and (i) lounge support connectors between longitudinally spaced portions of the rectangular framework on opposite sides of the lounge and the transversely extending connecting means at the upper ends of the converging side support members.

2. The invention defined in claim 1 wherein a collapsible shade is provided at one end of the lounge framework consisting of transversely extending members pivotally mounted adjacent one end of the rectangular shaped lounge framework, and a sheet of flexible material carried by the pivotally mounted members.

* * * * *